United States Patent [19]

Kuramoto et al.

[11] Patent Number: 4,660,961

[45] Date of Patent: Apr. 28, 1987

[54] COPYING APPARATUS FOR SYNTHESIZING IMAGES

[75] Inventors: Yukimasa Kuramoto, Hyogo; Hajimu Oonishi, Osaka; Yukio Sakai, Osaka; Yoshiki Hayashi, Osaka, all of Japan; Robert C. Wells, Arlington, Mass.

[73] Assignee: Matsushita Electric Industrial Co., Ltd., Osaka, Japan

[21] Appl. No.: 617,969

[22] Filed: Jun. 7, 1984

[51] Int. Cl.[4] ..... G03G 15/01

[52] U.S. Cl. ..... 355/4; 346/153.1; 355/3 R

[58] Field of Search ..... 355/3 R, 4, 14 R; 346/153.1, 155

[56] References Cited

U.S. PATENT DOCUMENTS

| | | | |
|---|---|---|---|
| 4,033,688 | 7/1977 | Orthmann | 355/4 |
| 4,398,816 | 8/1983 | Nakajima et al. | 355/4 X |
| 4,416,533 | 11/1983 | Tokunaga et al. | 355/4 |
| 4,515,462 | 5/1985 | Yoneda | 355/4 |
| 4,572,651 | 2/1986 | Komatsu et al. | 355/4 |

*Primary Examiner*—Fred L. Braun

*Attorney, Agent, or Firm*—Amster, Rothstein & Ebenstein

[57] ABSTRACT

A copying apparatus of the electrostatic type enables at least two images to be synthesized on one surface of a copying paper using original positive image sources without preparing negative image sources prior to the copying process. The copying apparatus can also synthesize a plurality of images in different colors on a single sheet of copying paper.

16 Claims, 9 Drawing Figures

12
+800 v 24
38
88
82
12
+800 v
+100 v
84
86

40
30
36
12
+800 v
+100 v
90
86

12
+1200 v
+800 v
90
86

12
+600-700v
+100 v
90
92
+800 v
86

56
60
62
50
58
54
48
12
90
100

68

COPYING APPARATUS FOR SYNTHESIZING IMAGES

DESCRIPTION OF THE INVENTION

This invention relates to a copying apparatus and more particularly to an electrostatic copying apparatus which is capable of synthesizing a plurality of images onto one piece of copying paper.

In the past, a method for synthesizing a plurality of images onto one piece of copying paper has been proposed which uses a negative image source (information contained in white or light colored characters and the non-information containing background portions being black or dark colored) converted from an original positive image source (information contained in black or dark colored characters and the non-information containing background portions being white or light colored). This method using a negative image source is carried out as follows. (1) A negative image source is prepared from an original positive image source. (2) A photosensitive surface of a copying apparatus is given a positive electric charge. (3) Light reflected from the negative image portion (i.e., white or light colored character area) of the negative image source is transmitted to the photosensitive surface to create a first latent image thereon by reducing the positive electric charge on the photosensitive surface in the areas of the photosensitive surface exposed to light (i.e., the information containing white or light colored areas) and causing no change in the charge on the areas of the photosensitive surface not exposed to light (i.e., the black or dark colored background areas). (4) A second negative image source is prepared from an original second positive image source. (5) Light reflected from the negative image portion (white or light colored character area) of the second negative image source is transmitted to the photosensitive surface to create a second latent image thereon by reducing the positive electric charge on the photosensitive surface which remained on the non-exposed area of the photosensitive surface after the first exposure to light in areas corresponding to the white or light colored character (i.e., information containing) area of the second negative image source. (6) A toner, such as a positively charged powder, is brought into contact with the photosensitive surface. Since the toner is charged with the same polarity as that of the positive electric charge originally applied to the photosensitive surface, the toner does not adhere to the non-exposed areas on the surface, at which areas the positive electric charge remains unchanged. Although the absolute polarity of the areas of the photosensitive surface exposed to light does not become negative (i.e., opposite to the original polarity) but is merely lower than the original positive electric potential, the toner will electrostatically adhere to the areas of the photosensitive surface exposed to light which correspond to the white or light colored character areas of the first and second negative image sources because of the difference of the electric potential between the toner and light-exposed areas. The latent images of the light-exposed areas on the photosensitive surface are thus made visible. The developing process thus far described may be generally called "reversal development" or "negative development". Next, the visible images are transferred to a piece of paper as follows. (1) A piece of plain paper is placed in contact with the photosensitive surface and given a negative charge, opposite in polarity to the toner. (2) The visible images of positively charged toner on the photosensitive surface are electrostatically attracted and transferred to the negatively charged paper. (3) The toner images are fused to the paper by heat. By this method, black characters are obtained on one piece of copying paper from two negative image (white or light colored) character sources.

While this method achieved the synthesizing of two images on a single sheet of paper, this method has a great disadvantage in that the original positive image source must be converted into a negative image source prior to copying. Heretofore, positive image sources could not be used directly for copying two images onto a single sheet of paper without preparing negative image sources because the white background area of the positive image source would cause the positive electric charge on the photosensitive surface to be drained away in all background areas of the photosensitive surface. Therefore, when the second image source is exposed on the same photosensitive surface, there would remain no electric charge to form a second latent image corresponding to the second positive image.

The present invention, therefore, has as its principal object the provision of a copying apparatus of the electrostatic type in which at least two images can be synthesized on one surface of a copying paper using original positive image sources without preparing negative image sources prior to the copying process.

Another object of the invention is to provide a copying apparatus which can synthesize a plurality of images in different colors on a single sheet of copying paper.

These and other objects are accomplished by a copying apparatus according to the present invention which includes a photosensitive body having a photosensitive surface responsive to incident light to change the electric potential of the photosensitive surface. A first electric potential is created on the photosensitive surface. The photosensitive surface is exposed to light controlled by a first positive image source to create in a first portion of the photosensitive surface a first latent image corresponding to the information in the first positive image source. After light exposure, the electric potential of the first portion of the photosensitive surface remains at the first electric potential, and the electric potential of a second portion of the photosensitive surface, other than the first portion thereof, is changed to a second electric potential. An additional electric potential is then placed on the photosensitive surface so that the electric potential of the first portion of the photosensitive surface is changed to a third electric potential and the second portion of the photosensitive surface is changed to substantially the first electric potential. The photosensitive surface is then exposed to light controlled by a second positive image source to create, in at least a part of the second portion of the photosensitive surface, a second latent image corresponding to the information in the second positive image source. At the same time, the electric potential of the first portion of the photosensitive surface is changed from the third electric potential to substantially the first electric potential, which is substantially equal to the electric potential of the second portion of the photosensitive surface containing the second latent image. Thus, the electric potentials of the photosensitive surface containing both the first and second latent images are substantially equal. The electric potential on the remainder of the photosensitive surface is changed by the second exposure to light to a second electric potential. Finally, means are provided for transferring the first and second latent images onto a single piece of copying paper wherein the first and second latent images are rendered visible.

In a specific embodiment of the invention, the first positive image source is an ordinary piece of paper on which the information containing characters are black or dark colored on a white or light colored background and the second positive image source is a character generator which is used to create information containing black or dark colored characters on a white or light colored background. The copying apparatus includes a photosensitive body having a photosensitive surface mounted for rotational movement in the copying apparatus. A first copying station disposed along the path of movement of the photosensitive surface includes a first charging assembly for creating a first electric potential on the photosensitive surface and a first light exposure assembly having a light source such as a halogen lamp or a fluorescent lamp for emitting light of a predetermined level to expose a first positive image source disposed at the first copying station. Light from the first positive image source is reflected therefrom onto the photosensitive surface to create a first latent image on the photosensitive surface in a first portion thereof and to form no image on a second portion of the photosensitive surface. The electric potential of the photosensitive surface in the first portion thereof wherein the first latent image is formed remains unchanged at the first electric potential while the electric potential of the photosensitive surface in the second portion is changed to a second electric potential. The first copying station also includes a first image development assembly at which toner is brought into contact with the photosensitive surface and adheres to the portion thereof at which the first latent image is formed rendering the same visible.

A second copying station is provided further along the path of movement of the photosensitive surface which includes a second charging assembly for charging the photosensitive surface such that the first portion thereof is changed to a third electric potential and the second portion thereof is changed to substantially the first electric potential. The second copying station includes a second light exposure assembly having a laser light source for emitting light of a predetermined level which is controlled by the character generator and a revolving mirror for reflected light from the laser onto the photosensitive surface. The laser light is modulated by the output signals of the character generator so that a second latent image is formed in at least a part of the second portion of the photosensitive surface. The electric potential of the photosensitive surface on which the second latent image is formed remains at the first electric potential. The electric potential of the area of the photosensitive surface wherein the first latent image is formed is changed to the first electric potential. The electric potential of the remaining area of the photosensitive surface is changed to a second electric potential. The second copying station also has a second image development assembly at which toner is brought into contact with the photosensitive surface and adheres to a portion thereof at which the second latent image is formed rendering the same visible. Finally, an image transfer assembly is provided further along the path of travel of the photosensitive surface at which the first and second images are transferred to a single sheet of copying paper.

In a more specific embodiment of the invention, the first development assembly uses a first developing agent having a positive polarity and a first color such as black, and the second development assembly uses a second developing agent having negative polarity and a second color, such as red, to create two visible images on the copying paper of different colors.

While the novel features of the invention are set forth with particularly in the appended claims, the invention, both as to organization and content, will be better understood and appreciated, along with other objects and features thereof, from the following detailed description taken in conjunction with the drawings, in which:

Figure 1:
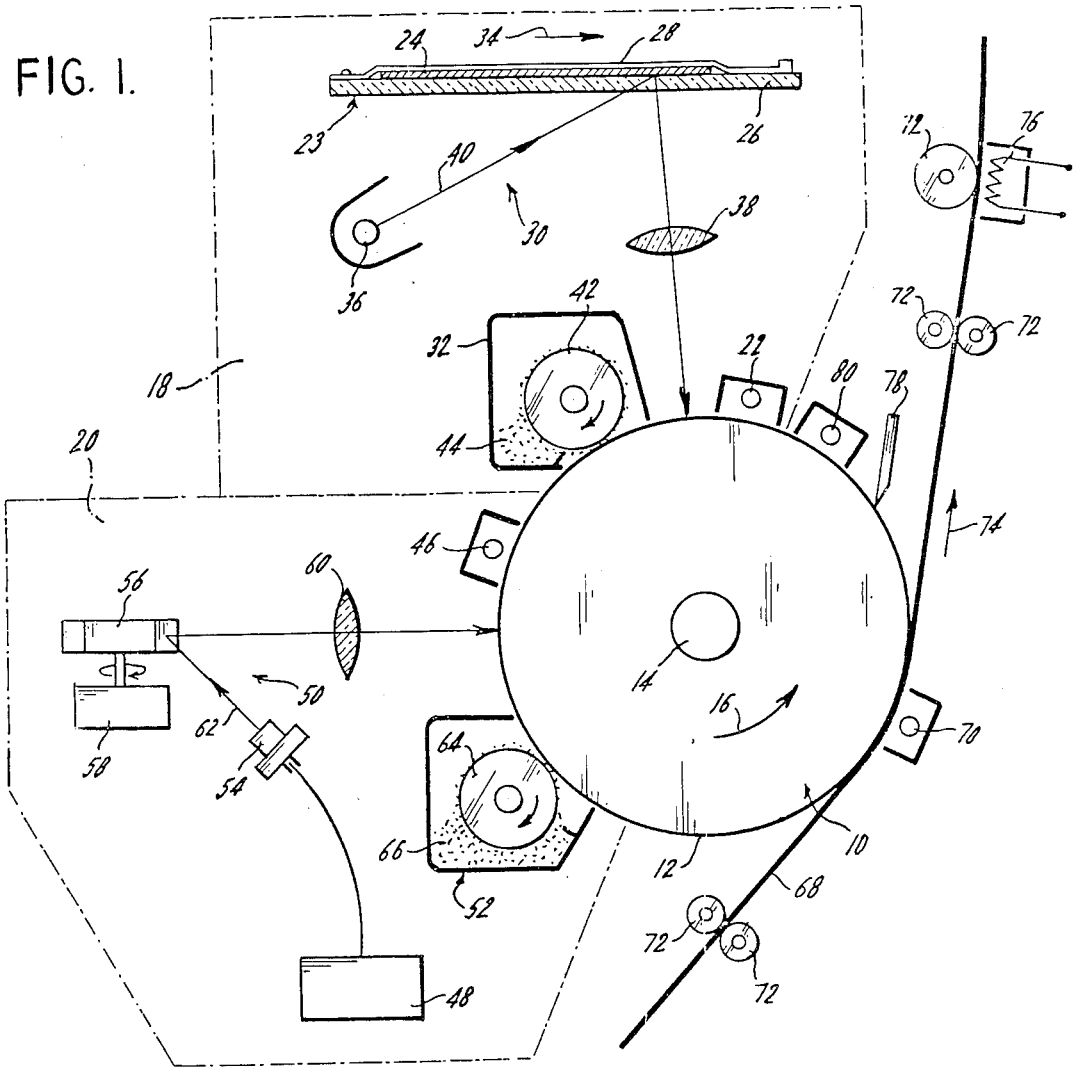
FIG. 1 is a schematic block diagram of a copying apparatus which provides synthesis of two images on a single sheet of copying paper in accordance with the invention.
Figure 3:
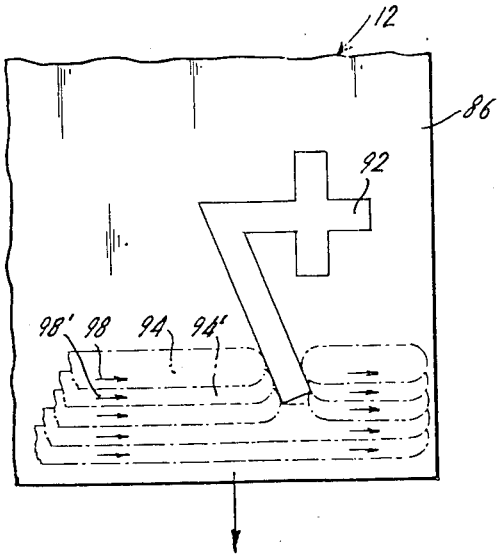
FIG. 3 is a partly enlarged plan view showing the formation of a latent image on the photosensitive surface using a beam of light from a laser.

Referring to FIG. 1, there is illustrated a copying apparatus which includes a system for synthesizing at least two positive images on a single copying paper. The copying apparatus includes a cylindrical drum type photosensitive body 10 which has a photosensitive surface 12 as its outer circumferential surface. The photosensitive body 10 is mounted rotatably in the copying apparatus by a support shaft 14 and rotates about the support shaft 14 in the direction of arrow 16, being driven by a motor (not shown). The photosensitive body 10 preferably is made of an aluminum tube and the photosensitive surface 12 is preferably formed of selenium-tellurium alloy of 60 to 70 m thickness so as to have high sensitivity to light in the wavelength of lamp light or laser light. First and second copying stations 18, 20 are disposed in spaced-apart relationship with respect to the path of travel of photosensitive surface 12.

The first copying station 18 includes a first electric charging assembly 22, a first image supporting assembly 23 including a first positive image source, such as an original document 24, which is placed on a transparent glass plate 26 and covered by a white surface of a cover sheet 28, a first light exposure assembly 30 and a first image development assembly 32. The first electric charging assembly 22 is disposed proximate the photosensitive surface 12 and provides on the photosensitive surface 12, for example, a uniform positive electric charge to create a first electric potential, for example of +800 V on the photosensitive surface 12. The first image support assembly 23 including original document 24, glass plate 26 and cover sheet 28 are moved in the direction of arrow 34 and the reverse direction thereof being driven by a motor (not shown). The first light exposure assembly 30 includes a lamp 36 such as a halogen lamp or a fluorescent lamp, and a refractive index distribution type lens 38. Light 40, which is emitted by lamp 36, is transmitted to the original document 24 through the glass plate 26 and, from there, the positive image (i.e., black or dark colored character portion containing information) of the original document 24 is reflected on the photosensitive surface 12 of the photosensitive body 10 through lens 38. A first latent image corresponding to the positive image on the original document 24 is formed on a first portion of the photosensitive surface 12 since the light 40 causes the electric potential of a second portion of the photosensitive surface 12 which is exposed to the light 40 reflected from the non-information containing background portions of original document 24 to change from the first electric potential of +800 V to a second electric potential, for example, of +100 V. The photosensitive surface 12 then passes the first image development assembly 32 which makes the first latent image visible. The first development assembly 32 is disposed proximate the photosensitive surface 12 and includes a cylindrical sleeve type magnetic roll 42 and negatively charged development agent 44 comprising an iron powder carrier and insulating powder toner. The development agent 44 which is charged oppositely to the positive electric charge on the photosensitive surface 12 is applied to the photosensitive surface 12 through the roll 42 which is direct-current (D.C.) biased by, for example +300 V. In this first development assembly 32, negatively charged toner adheres to the first portion of the photosensitive surface 12 having the first electric potential of +800 V, higher than the bias voltage +300 V, i.e., to the first latent image, but does not adhere to the second portion of the photosensitive surface 12 in which the electric potential is at the second electric potential of +100 V, lower than the bias voltage +300 V, to make the first portion corresponding to the first latent image visible.

The second copying station 20 includes a second charging assembly 46, a second positive image source, such as a character generator 48 which generates, for example, type character signals therefrom, a second light exposure assembly 50 and a second image development assembly 52. The second electric charging assembly 46 is disposed proximate the photosensitive surface 12 and provides on the photosensitive surface, for example, a uniform additional positive electric charge to provide an additional electric potential to the photosensitive surface 12, whereby the electric potential of the first portion of the photosensitive surface 12 is changed from the first electric potential, +800 V, to a third electric potential, for example of +1200 V, and the electric potential of the second portion of the photosensitive surface 12 is changed and preferably returned to the first electric potential of +800 V from the second electric potential, +100 V. The second light exposure assembly 50 includes a laser device 54, such as a helium-neon (He-Ne) gas laser or semiconductor laser, a revolving mirror 56 which is rotated by a drive motor 58 and a lens 60. Light beam 62, which is emitted by the laser device 54, is modulated by the character signals from the character generator 48 and is transmitted to the revolving mirror 56 which reflects the light beam 62. The light beam 62 reflected by the revolving mirror 56 is scattered transversely like a scanning electron beam of a conventional television receiver in response to the rotation of the revolving mirror 56 and the scanning light beam is transmitted to the photosensitive surface 12 through lens 60. The lens 60 is, for example, a $f\theta$ lens which keeps the light beam scanning speed constant on the photosensitive surface 12 regardless of the deflection angle of the light beam.

The above described laser-type character exposure assembly, namely the combination of the second light exposure assembly 50 and the character generator 48 is of conventional design and is disclosed in U.S. Pat. No. 3,898,627, entitled "Optical Printer Having Serializing Buffer For Use With Variable Length Binary Words".

A second latent image in accordance with the character signals from the character generator 48 is formed on a part of the second portion of the photosensitive surface 12 as follows. The electric potential of the first portion of the photosensitive surface 12 wherein the first visible image is formed is changed from the third electric potential, +1200 V to substantially the first electric potential, i.e., +600 to +700 V and the part of the second portion of the photosensitive surface 12 wherein the second latent image is formed remains at the first electric potential of +800 V because the photosensitive surface is not exposed to light in that part of the second portion of the photosensitive surface 12. The electric potential of the remaining part of the photosensitive surface 12 is charged to substantially the second electric potential, +100 V. The photosensitive surface 12 then passes the second image development assembly 52 which makes the second latent image visible. The second image development assembly 52 is disposed proximate the photosensitive surface 12 and, like the first image development assembly 32, includes a cylindrical sleeve-type magnetic roll 64 and negatively charged development agent 66 comprising an iron powder carrier and an insulating powder toner. In this second development assembly 52, like the first image development assembly 32, negatively charged toner adheres to the first portion of the photosensitive surface 12 having the first electric potential, i.e., to the second latent image, but does not adhere to the second portion of the photosensitive surface 12 in which the electric potential is at the second electric potential. Thereby, the second latent image is made visible on the photosensitive surface 12.

The first and second visible images are thereafter transferred to a single copying paper 68 by use of an image transfer charging assembly 70. The copying paper 68 is guided by rollers 72 and is moved in the direction of arrow 74 in compliance with the rotation of the photosensitive body 10. The image transfer charging assembly 70 provides on the copying paper 68, for example, a positive electric charge, i.e., a charge of the same polarity as that provided by charging assemblies 22, 46. The visible images formed by the negatively charged toner on the photosensitive surface 12 are attracted to the positively charged copying paper 68 and transferred to the copying paper 68. The transferred visible images on the copying paper 68 are fused to the copying paper 68 by heat from a heater 76. After the transfer of the images, the photosensitive surface 12 is cleaned by a cleaning blade 78 whose extremity is in contact with the photosensitive surface 12 and any remaining unnecessary electric charge on the photosensitive surface 12 is reduced to zero by a discharging assembly 80 which provides on the photosensitive surface 12, for example, a negative charge opposite to the positive charge provided by the charging assemblies 22, 46.

The overall operation of the copying apparatus in FIG. 1 is as follows. (1) The first charging assembly 22 of the first copying station 18 provides on the photosensitive surface 12 a positive electric charge to create a first electric potential of +800 V on the photosensitive surface 12. (2) The photosensitive surface 12 is exposed to light 40 emitted by the first light exposure assembly 30 and light reflected from the white or light colored background areas of the first positive image source, such as original document 24, is transmitted to the photosensitive surface 12. The electric potential of a first portion of the photosensitive surface 12 not exposed to light, which corresponds to the black or dark colored character or information containing areas of the positive image source 24, remains uncharged at the first electric potential of +800 V, and a second portion of the photosensitive surface 12 exposed to light 40, which corresponds to the white or light colored background or non-information containing areas of the first positive image source is changed to a second electric potential of +100 V, thereby forming a first latent image on the photosensitive surface 12. (3) The photosensitive surface 12 then passes the first image development assembly 32 in which toner adheres to only the first portion of the photosensitive surface 12 having the first electric potential, i.e., first latent image, thereby making the first latent image visible. (4) The second charging assembly 46 of the second copying station 20 provides on the photosensitive surface 12 an additional electric charge to provide an additional electric potential to the photosensitive surface 12, whereby the electric potential of the first portion of the photosensitive surface 12 which had not been exposed to light is changed to a third electric potential of +1200 V and the electric potential of the second portion of the photosensitive surface 12 exposed to light is returned to the first electric potential of +800 V. (5) The photosensitive surface 12 is again exposed to light 62 emitted by the second light exposure assembly 50 and light 62 responsive to the information of the second positive image source, such as the character generator 48, is transmitted to the photosensitive surface 12 to create in at least a part of the second portion of the photosensitive surface 12 a second latent image corresponding to the information in the second positive image source 48 as follows. The electric potential of the first portion of the photosensitive surface 12 is changed to substantially the first electric potential, e.g., +600 to +700 V, the electric potential of the part of the photosensitive surface 12 in the second portion thereof corresponding to the second latent image remains at the first electric potential of +800 V and the electric potential of the remainder of the photosensitive surface 12 is changed to the second electric potential of +100 V. (6) A toner of the second image development assembly 52 adheres to the portion of the photosensitive surface 12 having the first electric potential, i.e., the second latent image, but does not adhere to the portion of the photosensitive surface 12 in which the electric potential is at the second electric potential. The portions of the photosensitive surface 12 corresponding to the first and second latent images are now visible. (7) The visible images are thereafter transferred to the copying paper 68 by the transfer charging assembly 70 and fixed on the paper 68 by the heat of the heater 76.

The above operation is explained in more detail with reference to FIGS. 2A–2G and 3.

Figures 2A, 2B, 2C, 2D, 2E, 2F, 2G:
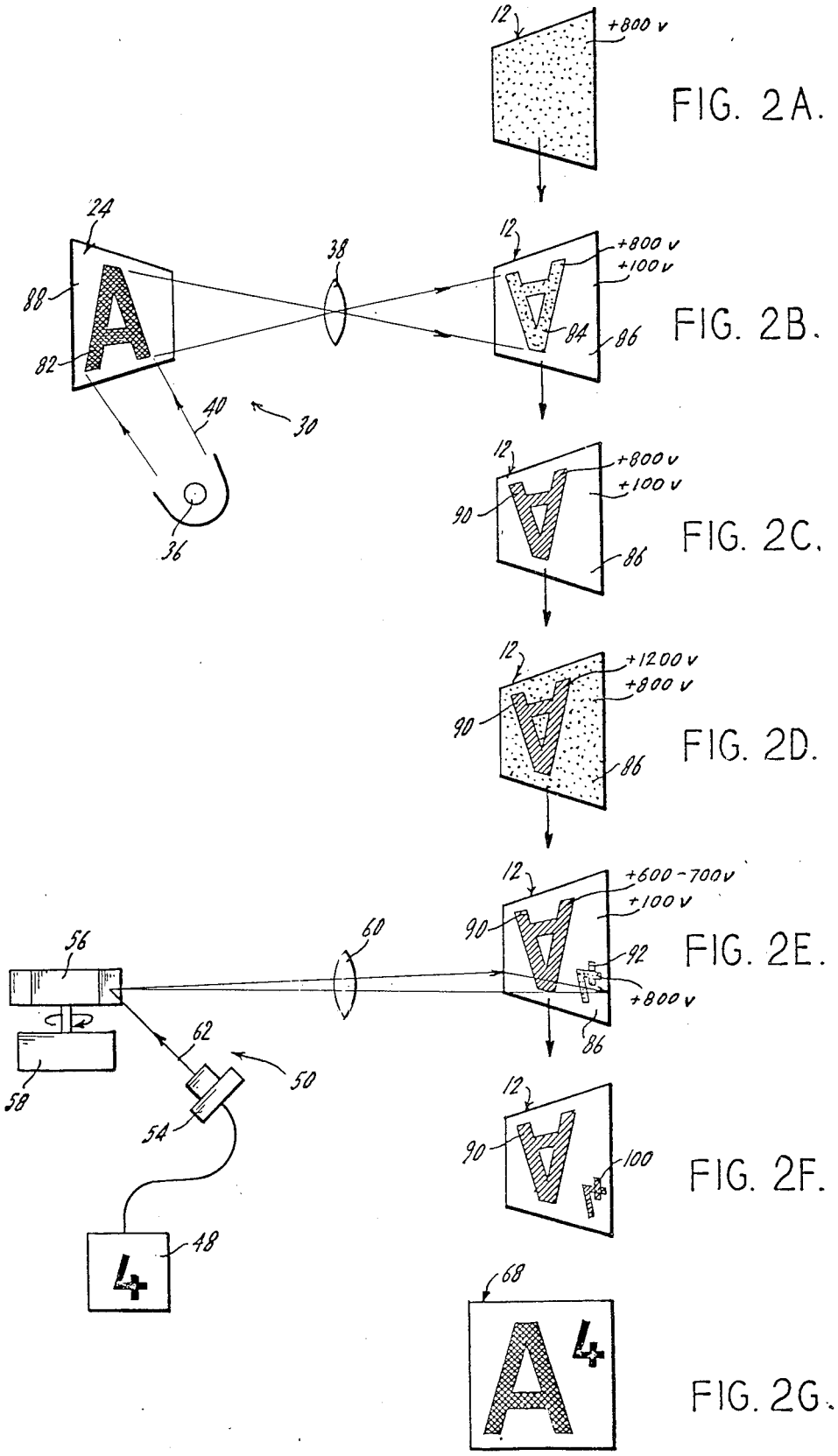
FIGS. 2A–2G are representations illustrating the way in which images from two positive image sources can be formed on a single copying paper in accordance with the invention.

(A) The entire photosensitive surface 12 of the photosensitive body 10 is given a first electric charge by the first charging assembly 22 as shown in FIG. 2A, in which dot marks indicate the first positive electric charge. In the described embodiment, the first electric potential of the photosensitive surface 12 is +800 V.

(B) In FIG. 2B, the first positive image source 24 is exposed to light 40 emitted from lamp 36 which light is transmitted to the photosensitive surface 12 through lens 38. A first latent image corresponding to a black or dark colored character area 82 of the original document 24 is formed on a first portion 84 of the photosensitive surface 12 since the light 40 causes the electric potential of a second portion 86 of the photosensitive surface 12 which is exposed to the light 40 reflected from the white or light colored background 88 of the original document 24 to change from the first electric potential, +800 V to a second electric potential, +100 V or less. The electric potential of the first portion 84 of the photosensitive surface 12 remains unchanged at the first electric potential, +800 V.

(C) The photosensitive surface 12 then passes the first development unit 32 in which toner adheres to only the first portion 84 of the photosensitive surface 12 having the first electric potential, +800 V and does not adhere to the second portion 86 of the photosensitive surface 12. The first latent image is thus made visible, as indicated by reference numeral 90 in FIG. 2C.

(D) The second charging assembly 46 of the second copying station 20 provides an additional positive electric charge to the photosensitive surface 12. Thereby, as shown in FIG. 2D, the electric potential of the first portion, i.e., the first visible image area 90, is increased from the first electric potential, +800 V. to a third electric potential, +1200 V. The electric potential of the second portion 86 of the photosensitive surface 12 is also increased from the second electric potential +100 V to the first electric potential +800 V.

(E) In FIG. 2E, the light beam 62, which is emitted from the laser device 54 and modulated by character signals from the character generator 48, is scanned across the photosensitive surface 12 by the revolving mirror 56 to form a second latent image at a part 92 of the second portion 86 of the photosensitive surface 12. The light beam 62 is thus applied to the entire photosensitive surface 12 other than the part where the second latent image 92 is formed. The light beam 62 is scanned (FIG. 3) in such manner that the radiating points 94 on a scanning line 98 overlap by, for example, half the adjacent radiating points 94' on an adjacent scanning line 98' to make the second image clearer and more precise. In this second light exposure process, the light level of light beam 62 is the same as that of light 40 used in the first light exposure process. The electric potential of the first portion or the first visible image area 90 is decreased from the third electric potential, +1200 V to substantially the first electric potential, +600 V to +700 V by the light beam exposure. The electric potential of the second latent image part 92 of the second portion 86 of the photosensitive surface 12 remains at the first electric potential +800 V. The electric potential of the remaining portion of the photosensitive surface 12 is decreased from the first electric potential, +800 V to the second electric potential, +100 V or less.

(F) The photosensitive surface 12 then passes the second image development assembly 52 in which, like the first image development assembly 32, toner adheres to the second latent image part 92 of the photosensitive surface 12 having the first electric potential, +800 V to make the second latent image visible. In this case, a slight amount of the toner also adheres to the first visible image area 90 having substantially the first electric potential. This may cause the density of the first and second visible images to be different from each other. To solve this problem, the density of the first development agent 44 is lowered compared with that of the second development agent 66 and a bias voltage applied to the second roll 64 is adjusted in such manner that the first and second visible images become equal in the density. The second visible image is designated by reference numeral 100 in FIG. 2F.

(G) The two visible images are then transferred to the copying paper 68 by placing the copying paper 68 in contact with the photosensitive surface 12 and charging the paper 68 with the image transfer charging assembly 70. The copying paper 68 is fed through the heater 76 for fixing the visible images by the heat of the heater 76 to produce the first and second visible images on the copying paper 68.

While in the above embodiment, the photosensitive surface 12 is charged positively by charging assemblies 22, 46, the photosensitive surface may be charged negatively. For example, the first electric potential is −800 V, the second electric potential, −100 V, the third electric potential, −1200 V, the roller biasing D.C. voltage, −300 V and so on. In this case, the developing agents 44, 66 are positively charged and the photosensitive surface 12 is made of cadmium sulfide (CdS) resin.

While the above embodiment is described as black and white copying apparatus, it is also possible to create a multicolor copy by using different color developing agents 44, 66. If the color of the first and second development agents 44, 66 is different from each other to make the color of the first and second visible images different, a problem arises in the above embodiment since the second development agent 66 adheres to the first visible image portion 90 having a different color and deteriorates the color of the first visible image.

This problem can be solved as follows. Light beam 62 from the laser device 54 is applied to the second latent image part 92 only and not applied to the non-second latent image part 86. Therefore, the electric potential of the second latent image part 92 is lowered from the first electric potential +800 V to the second electric potential, +100 V or less. The bias potential applied to the roll 64 is raised to, for example, about +600 V, and toner of positive polarity is used as the second development agent 66. Accordingly, in the second development process, the toner of positive potential adheres to only the second latent image part 92 of lowered electric potential, +100 V, and does not adhere to the first visible image area 90 formed by toner of negative polarity (the first development agent 44) or the non-latent image part 86 of the photosensitive surface 12 because the electric potential in those areas exceeds the electric potential of the toner, i.e., the bias potential +600 V. Thus, when the first development is executed with toner of negative polarity and the second development is executed with toner of positive polarity, the toners do not mix at the time of the second development. Therefore, if the toners of different colors are used, clear two-color images are developed. For example, when a black color is used for the first image and a red color for the second image, clear legible two color copy images are obtained without color deterioration. In the image transfer process, since toners of opposite polarities are used, the entire photosensitive surface 12 must be charged to electric potential having a single polarity prior to transferring the images to the copying paper. This is accomplished, using conventional methods, by placing a charging assembly along the path of travel of the photosensitive surface 12 between the end of second copying station 20 and image transfer charging assembly 70. The images are then transferred to the copying paper 68 by the image transfer charging assembly 70.

While in the above embodiments, first and second image development assemblies 32, 52 are used, the first image development assembly 32 can be eliminated. That is, the first latent image, which is formed by the first copying station 18 on the photosensitive surface 12, is developed by the second image development assembly 52 as well as the second latent image produced by the second copying station 20. By this system, the possible problem stated above, i.e., the density difference between first and second visible images in case of using two development assemblies 32, 52, is reduced.

While in the above embodiments, the first light exposure assembly 30 includes a lamp and the second light exposure assembly 50 includes a laser, the first exposure assembly can use a lamp or both exposure assemblies can include either lamps or lasers or some other type light source.

While in the above embodiments, the laser device 54 is used to produce a light beam, the same effects can be obtained by using a plurality of light emitting diodes arranged in a line which corresponds to the scanning line of the light beam 62 or an optical fiber tube. In this case, the revolving mirror 56 and its drive motor 58 can be omitted.

Furthermore, the above-described copying apparatus can be used as an ordinary copying machine or an optical printer. That is, if only the lamp type exposure assembly 30 is used, the apparatus functions as an ordinary copying machine, while if only the laser type exposure assembly 50 is used, the apparatus functions as an optical printer.

Still further, in the above embodiments, it is easy to adjust the relative position of the first and second visible images on the copying paper. If the forward end of the original document 24 is detected by detecting means and thereafter the operation of the character generator 48 is delayed by an arbitrary time set by a user, the vertical relative position of the two images can be adjusted. On the other hand, if the scanning width of the light beam 62 is adjusted by a control circuit, the horizontal relative position of the images can be adjusted.

While in the above embodiments, light 38 is fixed and the document is moved, light 38 may be moved and the document 24 may be fixed.

While specific embodiments of the invention have been illustrated and described herein, it is realized that modifications and changes will occur to those skilled in the art. It is therefore to be understood that the appended claims are intended to cover all modifications and changes as fall within the true spirit and scope of the invention.

What is claimed is:

1. A copying apparatus for creating images from at least two positive image sources onto a single piece of copying paper, comprising:

a photosensitive body having a photosensitive surface;

means for creating a first electric potential on said photosensitive surface;

means responsive to the information contained in a first positive image source for creating on a first portion of the photosensitive surface a first latent image corresponding to the information in the first positive image source, the electric potential of the first portion of the photosensitive surface remaining at said first electric potential, and the electric potential of a second portion of the photosensitive surface other than said first portion thereof being changed to a second electric potential;

means for providing an additional electric potential to said photosensitive surface, thereby the electric potential of said first portion of the photosensitive surface being changed to a third electric potential, and the electric potential of said second portion of the photosensitive surface being changed to substantially said first electric potential;

means responsive to the information contained in a second positive image source to create in at least a part of the second portion of the photosensitive surface a second latent image corresponding to the information in the second positive image source, the electric potential of the first portion of the photosensitive surface being changed to substantially said first electric potential and the electric potential of the part of the photosensitive surface in the second portion thereof corresponding to the second latent image remaining at the first electric potential and the electric potential of the remainder of the photosensitive surface being changed to the second electric potential; and means for transferring the first and second latent images onto a single piece of copying paper wherein the first and second latent images are rendered visible.

2. A copying apparatus for creating images from at least two positive image sources onto a single piece of copying paper, comprising:

a photosensitive body having a photosensitive surface;

means for creating a first electric potential on said photosensitive surface;

means for exposing the photosensitive surface to light controlled by the information from a first positive image source to create on a first portion of the photosensitive surface a first latent image corresponding to the information in the first positive image source, the electric potential of the first portion of the photosensitive surface remaining at said first electric potential, and the electric potential of a second portion of the photosensitive surface other than said first portion thereof being changed in accordance with light exposure to a second electric potential;

means for providing an additional electric potential to said photosensitive surface, thereby the electric potential of said first portion of the photosensitive surface being changed to a third electric potential, and the electric potential of said second portion of the photosensitive surface being changed to substantially said first electric potential;

means for exposing the photosensitive surface to light controlled by the information in a second positive image source to create in at least a part of the second portion of the photosensitive surface a second latent image corresponding to the information in the second positive image source, the electric potential of the first portion of the photosensitive surface being changed to substantially said first electric potential and the electric potential of the part of the photosensitive surface in the second portion thereof corresponding to the second latent image remaining at the first electric potential and the electric potential of the remainder of the photosensitive surface being changed to the second electric potential; and means for transferring the first and second latent images onto a single piece of copying paper wherein the first and second latent images are rendered visible.

3. A copying apparatus for synthesizing at least first and second positive images on a single copying paper, comprising:

a photosensitive body having a photosensitive surface;

a first charging assembly disposed along said photosensitive surface for providing on the photosensitive surface a uniform electric charge to create a first electric potential on the photosensitive surface;

a first exposure assembly disposed along said photosensitive surface for emitting light to expose a first positive image source, light from said first positive image source being reflected therefrom onto the photosensitive surface to create a first latent image on said photosensitive surface in a first portion thereof and to form no image on a second portion of said photosensitive surface, the electric potential of the photosensitive surface in the first portion thereof wherein the first latent image is formed remaining unchanged and at the first electric potential, and the electric potential of the photosensitive surface of the second portion thereof being changed to a second electric potential;

a second charging assembly disposed along said photosensitive surface for providing on the photosensitive surface a uniform additional charge to provide an additional electric potential to said photosensitive surface, thereby the electric potential of said first portion of the photosensitive surface being changed to a third electric potential, and the electric potential of said second portion of the photosensitive surface being changed to substantially said first electric potential;

a second exposure assembly disposed along said photosensitive surface for emitting light responsive to said second positive image source, said light being reflected onto the photosensitive surface to create a second latent image on at least a part of the second portion thereof, the electric potential of the photosensitive surface on which the second latent image is formed remaining at the first electric potential, the electric potential of the area of the photosensitive surface wherein said first latent image is formed being changed to the first electric potential, and the electric potential of the remaining area of said photosensitive surface being changed to substantially said second electric potential; and means for transferring said first and second latent images onto a single piece of copying paper.

4. The copying apparatus of claim 3, wherein said image transferring means includes an image development assembly disposed proximate said photosensitive surface for developing only the portions of the photosensitive surface at the first electric potential to make said first and second latent images visible, an image transfer assembly for transferring said visible images to a copying paper, and an image fixing assembly for fixing the transferred visible images on the copying paper.

5. A copying apparatus for synthesizing at least first and second positive images on a single copying paper, comprising:

a photosensitive body having a photosensitive surface;

a first copying station disposed along said photosensitive surface, which includes, a first charging assembly for creating a first electric potential on said photosensitive surface, a first light exposure assembly for causing light to be transferred to and reflected from said first positive image source onto the photosensitive surface to create a first latent image on a first portion of said photosensitive surface, the electric potential of the photosensitive surface in the first portion thereof wherein the first latent image is formed remaining unchanged and at the first electric potential, and the electric potential of the photosensitive surface of a second portion thereof other than said first portion being changed to a second electric potential, and a first image development assembly for developing said first latent image to make said first latent image visible;

a second copying station disposed further along said photosensitive surface than said first copying station, which includes, a second charging assembly for providing an additional electric potential to said photosensitive surface, thereby the electric potential of said first portion of the photosensitive surface being changed to a third electric potential, and the electric potential of said second portion of the photosensitive surface being changed to substantially said first electric potential, a second light exposure assembly for causing light modulated in response to a second positive image source to be reflected onto at least a part of the second portion of the photosensitive surface to create a second latent image thereon, the electric potential of the photosensitive surface on which the second latent image is formed remaining at the first electric potential, the electric potential of the area of the photosensitive surface wherein said first latent image is formed being changed to the first electric potential, and the electric potential of the remaining area of said photosensitive surface being changed to substantially the second electric potential, and a second image development assembly for developing said second latent image to make said second latent image visible; and means for transferring said first and second visible images onto a single piece of copying paper.

6. The copying apparatus of claim 5 wherein said visible image transferring means includes an image transfer charging assembly for transferring said visible images to the copying paper and an image fixing assembly for fixing the transferred visible images onto the copying paper.

7. The copying apparatus of claim 5 wherein the light source of said first and second light exposure assemblies is a lamp and a laser device, respectively.

8. The copying apparatus of claim 5 wherein both said first and second exposure assemblies have substantially the same structure.

9. The copying apparatus of claim 7 wherein the exposure assembly using said laser device emits light beam to the entire photosensitive surface other than the portion wherein the second latent image is formed.

10. The copying apparatus of claim 9 wherein said light beam from said laser device is designed such that radiating points on a scanning line of light beam overlap the adjacent radiating points on an adjacent scanning line of light beam.

11. The copying apparatus of claim 5 wherein said first image development assembly uses a first development agent and said second image development assembly uses a second development agent whose polarity is opposite to that of the first development agent.

12. The copying apparatus of claim 11 wherein said first development agent has different color from said second development agent, thereby the color of said first visible image on the copying paper is different from that of said second visible image.

13. A copying apparatus for synthesizing at least first and second positive images in different colors on a single piece of copying paper, comprising:

a photosensitive body having a photosensitive surface;

a first copying station disposed along said photosensitive surface, which includes, a first charging assembly for creating a first electric potential on said photosensitive surface, a first light exposure assembly for causing light to be transmitted to and reflected from said first positive image source onto the photosensitive surface to create a first latent image on a first portion of said photosensitive surface, the electric potential of the photosensitive surface in the first portion thereof wherein the first latent image is formed remaining unchanged and at the first electric potential, and the electric potential of the photosensitive surface of a second portion thereof other than said first portion being changed to a second electric potential, and a first image development assembly including a first developing agent of a first color for developing said first latent image to make said first latent image visible in said first color;

a second copying station disposed further along said photosensitive surface in said first copying station, which includes, a second charging assembly for providing an additional electric potential to said photosensitive surface, thereby the electric potential of said first portion of the photosensitive surface being changed to a third electric potential, and the electric potential of said second portion of the photosensitive surface being changed to substantially said first electric potential, a second light exposure assembly for causing light modulated in response to a second positive image source to be reflected onto at least a part of the second portion of the photosensitive surface to create a second latent image thereon, the electric potential of the photosensitive surface on which the second latent image is formed remaining at the first electric potential, the electric potential of the area of the photosensitive surface wherein said first latent image is formed being changed to the first electric potential, and the electric potential of the remaining area of said photosensitive surface being changed to substantially the second electric potential, and a second image development assembly including a second development agent of a second color which is different from said first color of said first developing agent for developing said second latent image to make said second latent image visible in said second color; and means for transferring said first and second visible images in different colors onto a single piece of copying paper.

14. The copying apparatus of claim 13 wherein at least one of light exposure assemblies uses combination structure of a laser device and a character generator whose output signals modulate light beam emitted by said laser device.

15. The copying apparatus of claim 14 wherein said light beam is emitted to the entire photosensitive surface other than the portion wherein the latent image is formed.

16. The copying apparatus of claim 14 wherein said light beam is emitted to only the portion wherein the latent image is formed on the photosensitive surface, thereby the electric potential of the portion exposed to said light beam being changed to the second electric potential and a toner adhering the light beam exposed portion on the photosensitive surface.

* * * * *